US005641157A

United States Patent [19]

Mays et al.

[11] Patent Number: 5,641,157

[45] Date of Patent: Jun. 24, 1997

[54] SECURE CURRENCY STACKER BOX AND APPARATUS INCORPORATING THE SAME

[75] Inventors: David S. Mays; Robert E. Blevins, both of Mentor, Ohio

[73] Assignee: Diversified Technologies, Inc., Blue Bell, Pa.

[21] Appl. No.: 458,942

[22] Filed: Jun. 2, 1995

[51] Int. Cl.[6] ..... B65H 28/38

[52] U.S. Cl. ..... 271/181; 271/214

[58] Field of Search ..... 271/180, 181, 271/214, 215; 232/43.2, 15

[56] References Cited

U.S. PATENT DOCUMENTS

| | | | |
|---|---|---|---|
| 5,251,738 | 10/1993 | Debrowski | 271/181 |
| 5,372,361 | 12/1994 | Isobe et al. | 271/181 |
| 5,405,131 | 4/1995 | Zoyzoules | 271/181 |
| 5,411,249 | 5/1995 | Zoyzoulas | 271/181 |
| 5,421,443 | 6/1995 | Hatamachi et al. | 271/180 |

FOREIGN PATENT DOCUMENTS

| | | | |
|---|---|---|---|
| 0058494 | 5/1979 | Japan | 271/180 |
| 0012043 | 1/1984 | Japan | 271/180 |
| 4-201929 | 7/1992 | Japan | 271/214 |

*Primary Examiner*—H. Grant Skaggs

*Attorney, Agent, or Firm*—Caesar, Rivise, Bernstein, Cohen & Pokotilow, Ltd.

[57] ABSTRACT

Apparatus for validating paper currency banknotes and for forming a stack of such banknotes for removal from the apparatus. The apparatus includes a removable stacker box, a note acceptor for validating a paper currency banknote inserted in the apparatus, a transport mechanism for carrying the validated banknote to the stacker box, and a drive assembly including a motor and a pusher rod coupled to the motor for reciprocation thereby. The currency stacker box is in the form of an enclosed housing containing a holding plate, a pair of carrier belts and associated guide members, and a pusher plate. The housing includes a first small access opening, and a narrow slot through which the banknotes are introduced edgewise for engagement by the carrier belts. The carrier belts carry the validated banknote in front of the pusher plate. The pusher rod is arranged to extend through the small access opening in the currency stacker box when the stacker box is mounted in the apparatus. When reciprocated by the motor the pusher rod engages the pusher plate to cause the pusher plate to push the banknote from the carrier belts onto a stack on the holding plate. When the currency stacker box is full of validated banknotes it may be removed from the apparatus by operating a latching mechanism, leaving the pusher rod connected to the apparatus. A lockable door is provided on the stacker box to provide access to the banknotes stored therein.

14 Claims, 4 Drawing Sheets

SECURE CURRENCY STACKER BOX AND APPARATUS INCORPORATING THE SAME

BACKGROUND OF THE INVENTION

This invention relates generally to currency stackers apparatus, and particularly to apparatus for validating paper currency and for providing the same into tamper-proof currency stackers boxes, such as used in the gaming or vending industries.

Gaming or vending apparatus frequently include devices for receiving paper money, validating it, providing it into a secure receptacle, and providing a signal to the apparatus, e.g., a slot machine (in the case of the gaming industry), a non-alcoholic beverage vending machine (in the case of the vending industry), etc., of the acceptance of the paper currency.

In particular, prior art currency handling apparatus typically include a cash or "stacker" box for storing a stack of accepted paper currency bills or banknotes therein, a currency validator for checking the validity of a paper bill or banknote inserted into the validator, and a transport mechanism for carrying an accepted bill or banknote from the validator into the cash box or for ejecting a rejected, i.e., non-validated, bill or banknote. The validator typically comprises plural conveyor belts for engaging the longitudinal edges of the inserted bill or banknote to carry it past a plurality of optical and magnetic sensors. The sensors serve to sense various portions of the bill and to provide electrical signals responsive thereto to associated microprocessor or control means (usually forming a portion of the validator or, in some cases, forming a portion of the apparatus to which the validator is connected) to determine if the bill is a valid, and its denomination. If the bill is genuine, the bill is transported by the transport mechanism, e.g., a pair of belts which also engage the longitudinal peripheral edges of the bill or banknote, into a waiting cash box.

One type of prior art stacker box includes a banknote conveying mechanism, e.g., a pair of drive belts, and an associated "punch" plate mechanism (e.g., a pusher) and means to operate the same so that a banknote introduced into the stacker box is carried to a position therein where it is pushed by the punch plate mechanism onto a stack of banknotes already within the box. Once the cash box is full, i.e., the stack of bills reaches a predetermined amount, it is removed from the apparatus, the currency removed therefrom, and then it is remounted to the apparatus for reuse. One example of the foregoing type of stacker box is shown in U.S. Pat. No. 5,344,135 (Isobe et al.).

While the above type of stacker box is suitable for its intended purposes, it is somewhat complex in construction and hence relatively expensive to manufacture and maintain. In U.S. Pat. No. 5,372,361 (Isobe et al.) there is disclosed a stacker box with a removable punch plate assembly. While that device enables reuse of the punch plate mechanism, thus lowering costs somewhat, it still leaves much to be desired from the standpoint of complexity and expense.

A need thus exists for a cash box and a paper currency handling apparatus which is simple in construction, low in cost, and which provides sufficient security for its contents.

OBJECTS OF THE INVENTION

Accordingly, it is a general object of this invention to provide a device which overcomes the disadvantages of the prior art and which addresses the aforementioned need.

It is another object of this invention to provide a device for stacker box which is simple in construction, low in cost and which provides good security for paper currency stacked therein.

It is still another object of this invention to provide apparatus, including a stacker box, for validating paper currency banknotes and for transporting them into the stacker box, wherein a portion of the mechanism for stacking the banknotes within the stacker box does not form any portion of the box, but rather of the apparatus.

SUMMARY OF THE INVENTION

These and other objects of this invention are achieved by providing apparatus including currency stacker box for releasable mounting thereto. The apparatus is arranged for receipt of a paper currency banknote to validate the banknote and to transport the validated banknote into the stacker box for secure storage therein.

In accordance with one aspect of this invention the apparatus for validating the paper currency includes note acceptor means for validating a paper currency banknote inserted therein, transport means for carrying the validated banknote to the stacker box, and drive means including a motor and an associated reciprocable pusher rod for entry into the stacker box for causing a pusher plate in the stacker box to stack the paper currency note in a stack within the box.

The stacker box basically comprises an enclosed housing or shell, in which the heretofore mentioned pusher plate is located. A receiver for forming a stack of banknotes thereon, and carrier means are also located within the stacker box shell. The stacker box shell includes two small access apertures, and a narrow slot sufficiently sized for enabling the validated currency note to pass edgewise therethrough into the interior of the stacker box. The receiver, e.g., a spring biased holding plate, is disposed in a predetermined vertical plane within the shell and is arranged for receipt of the validated currency note to form a stack of such notes upon the introduction of additional validated currency banknotes into the housing.

The carrier means is located adjacent the slot and is arranged for carrying the validated banknote from the slot to the predetermined position within the housing so that the validated banknote is disposed adjacent the pusher plate. The pusher plate is arranged for pushing the validated banknote from the carrier means onto the receiver, e.g., the note holding plate.

The pusher rod of the apparatus extends from the apparatus' drive means through one of the two small apertures in the stacker box housing when the stacker box is mounted to the apparatus so that the pusher rod engages the pusher plate. The pusher rod is arranged to be reciprocated by the drive means of the apparatus, e.g., the pusher rod includes a toothed surface, e.g., a rack, arranged to engage a rotatable gear, e.g., a pinion, of the drive means, whereupon the pusher plate is reciprocated towards and away from the holding plate to push the validated banknote onto the receiver.

In accordance with a preferred embodiment of the invention the housing includes a lockable door to provide access to the interior of the housing and the stack of currency notes therein.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 2:
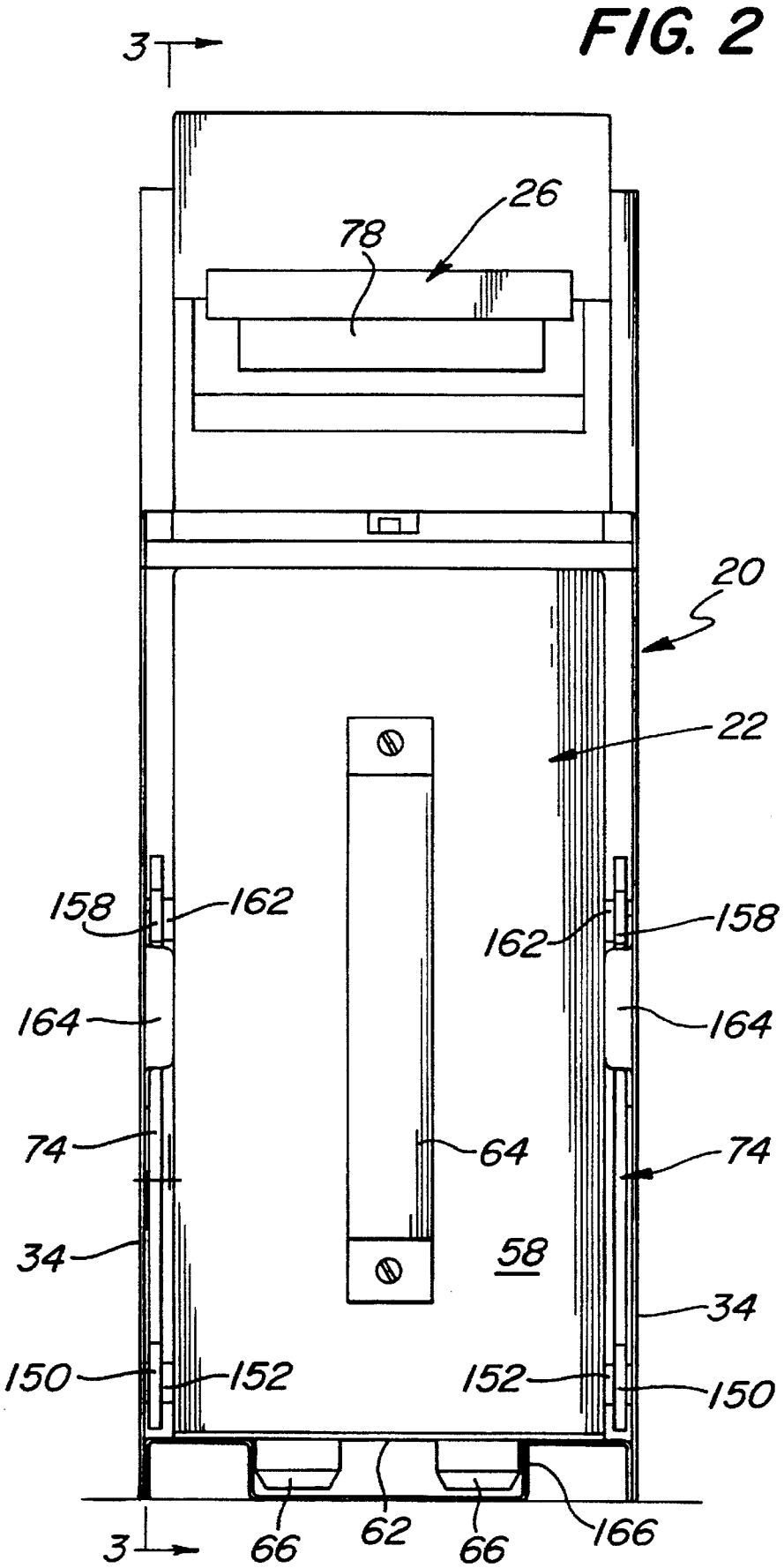
FIG. 2 is an enlarged front elevational view of the stacker box of FIG. 1 shown mounted in apparatus constructed in accordance with this invention for validating paper currency and transporting it to the stacker box.

Referring now to various figures of the drawing where like reference numerals refer to like parts there is shown at 20 in FIG. 2, apparatus for validating and storing paper currency therein. The apparatus includes a cash or stacker box 22. The stacker box is arranged to receive validated banknotes from the apparatus 20 to form a stack of such banknotes therein. The stacker box is releasably mounted in the apparatus 20, so that when the stacker box is full it can be removed from the apparatus and taken to some secure location at which it can be emptied. The only access to the interior of the stacker box where the stack of banknotes is located is through a lockable door on the box. Thus, when the stacker box has been removed from the apparatus 20 access to the banknotes can only be achieved by opening the door of the stacker box.

The apparatus 20 can form a portion of any suitable machine 24 (FIG. 3), e.g., a slot machine, a vending machine, etc, and basically comprises a bill acceptor or validator 26, an associated paper currency transporting mechanism 28, a motor drive assembly 30, and an electronic controller and a power supply module 32. Those components are mounted within a housing 34 having an upper portion in the form of a pivotable cover 36 to provide access to the currency transporting mechanism 28 for routine servicing thereof or to clear a banknote which may have become jammed in that mechanism. The currency transporting mechanism 28 is mounted onto a frame 38 within the cover 36.

The bill acceptor 26 can be of any conventional construction. One particularly suitable bill acceptor is constructed in accordance with the teachings of our co-pending patent application, Ser. No. 08/454,997, filed on May 31, 1995, and now U.S. Pat. No. 5,547,062, entitled Universal Currency Acceptor, which is assigned to the same assignee as this invention, and whose disclosure is incorporated by reference herein.

It should be pointed out that while the apparatus 20 shown herein is in the form of a vertical down-stacking gaming stacker, that embodiment is merely exemplary. Thus, the apparatus 20 can be in the form of a vertical up-stacking gaming stacker, or a horizontal gaming stacker.

The cash or stacker box 22, will be described in detail later. Suffice it for now to state that it is very simple in construction so that it can be made and maintained at low cost. The box basically comprises a hollow housing or shell 40 in which a pusher plate 42 (and associated components), a note conveyor subassembly 44, and a banknote receiver in the form of a holding plate 46 (and associated components) are located. The shell is formed of any suitable, strong material, e.g., steel.

The receiver's holding plate is arranged to receive and hold a stack 48 of banknotes 50 (FIGS. 4 and 5) thereon. The banknotes are provided into the interior of the cash box 22 from the apparatus' bill validator 26 by its transporting mechanism 28 when the cash box 22 is secured to it. In particular, the validated banknote 50 is introduced end edgewise into the interior of the cash box and carried to a predetermined position in front of the pusher plate 42 by the note conveying subassembly 44. A rod (to be described later) of the motor drive assembly 30 of the apparatus 20 is arranged to extend through a small access opening (also to be described later) in the cash box's shell to engage the pusher plate 42 when the cash box 22 is mounted to the apparatus 20. Thus, when the motor drive 20 is operated the pusher plate 42 engages or pushes the banknote 50 from the conveying subassembly 44 to the holding plate 46 of the receiver, e.g., on the top of the stack 48 of previously stacked banknotes or on the holding plate itself (if there are no banknotes already stacked thereon).

Figure 1:
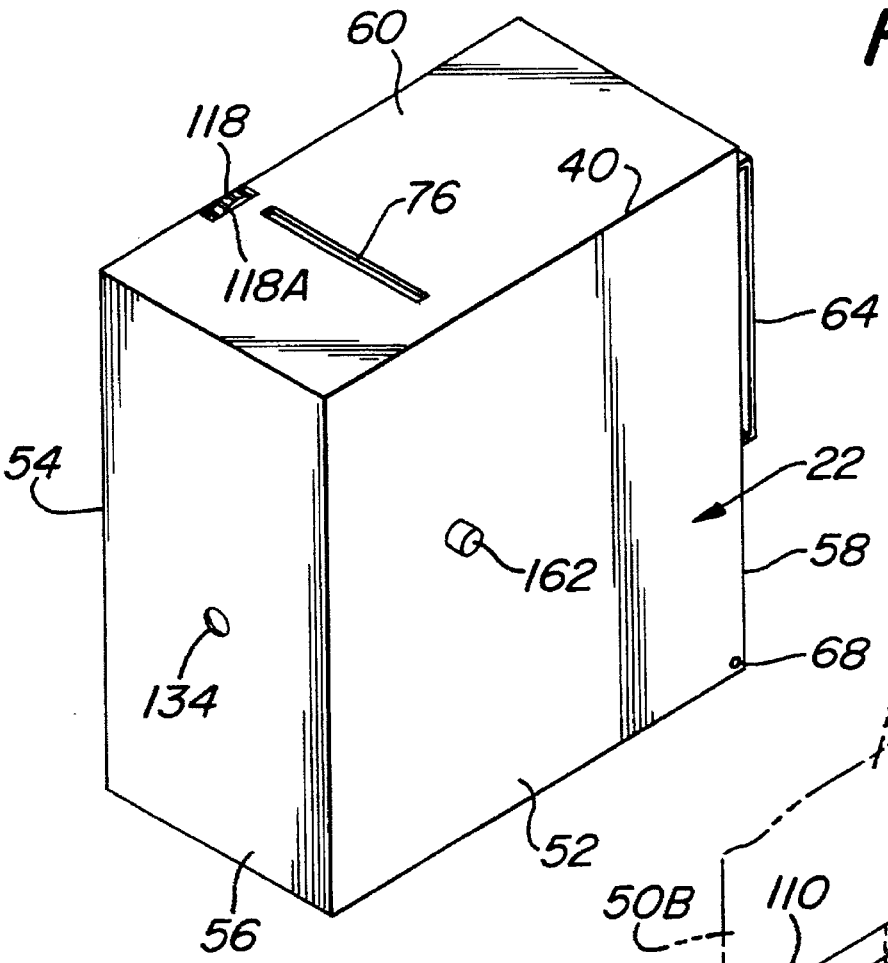
FIG. 1 is an isometric view of a stacker box constructed in accordance with this invention.
Figure 4:
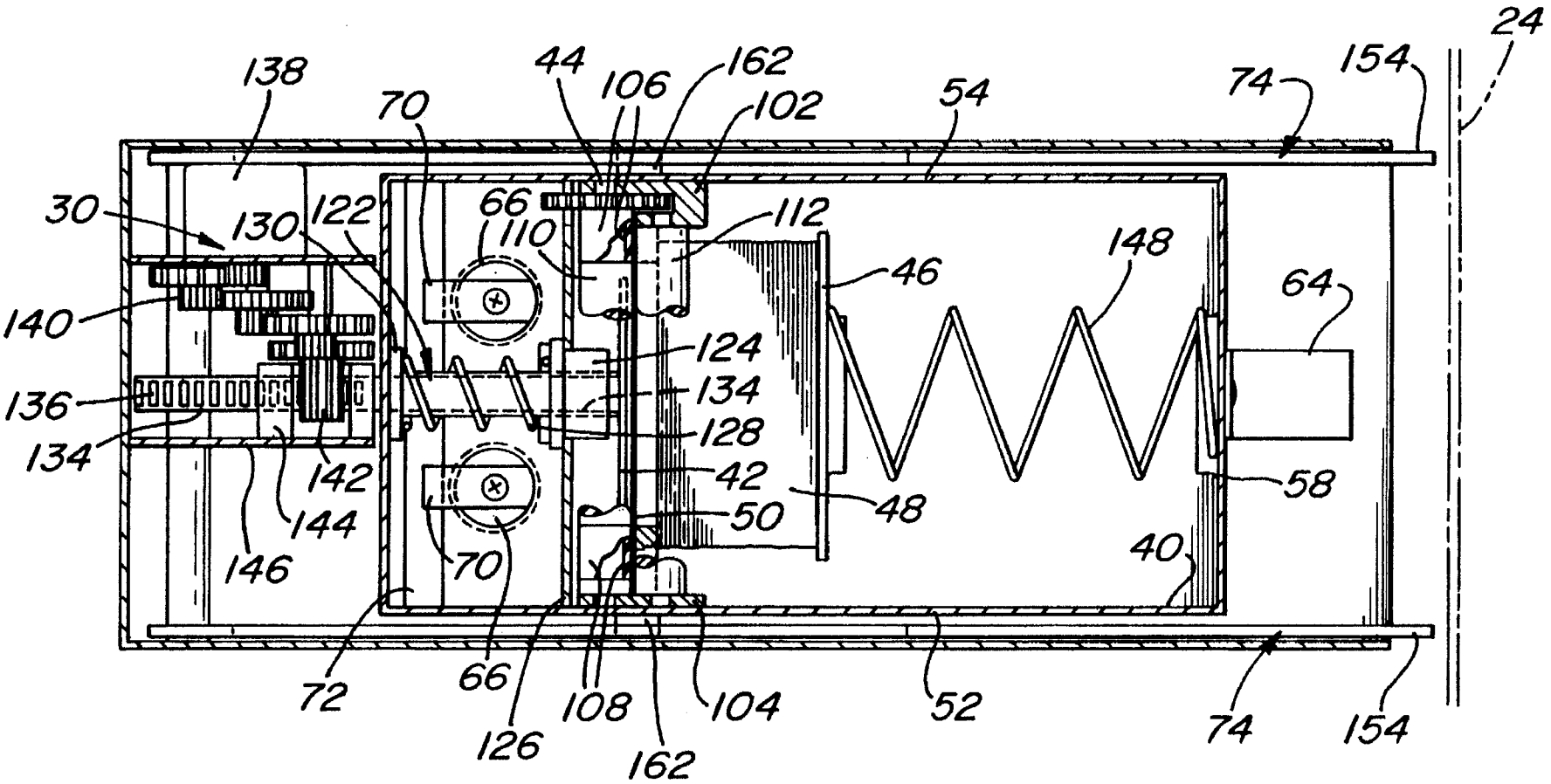
FIG. 4 is a sectional view taken along line 4—4 of FIG. 3.

The details of the cash box 22 will be set forth hereinafter. Thus, as can be seen in FIGS. 1 and 2 the outer shell 40 of the cash box comprises a pair of exterior side walls 52 and 54, an exterior rear wall 56, an exterior front wall 58, and an exterior top wall 60. The bottom of the cash box does not include any wall. Rather, it includes a pivotable, lockable front door 62. The front wall 58 has a handle 64 fixedly secured thereto. A pair of locks 66 for locking the door to preclude access to the interior of the cash box are provided on the door. The cash box door 62 is hinged at its bottom by a hinge 68 and is arranged to be pivoted open, i.e., downward, by unlocking the currency removal locks 66, whereupon access to a stack of bank notes 48 inside the cash box can be had, as can be seen in FIG. 4. Each lock 66 is rotatable when in receipt of an associated key (not shown) and includes a cam 70 which is arranged to be trapped behind a common stop bar 72 extending across the bottom of the cash box between the interior surfaces of its side walls 52 and 54. When each lock is unlocked by its associated key it can be rotated to bring its cam 70 out of engagement with the common stop bar 72. When both cams are unlocked the door 62 can be opened.

A latching mechanism 74 is provided for releasably securing the stacker box 22 to the apparatus 20. The details of that mechanism will be discussed later.

As best seen in FIG. 1, the top wall of the cash box includes an narrow entrance slot 76 through which the banknotes 50 are transported end edgewise by the transporting mechanism 28 after they have been validated. The paper currency banknotes are validated and transported to the cash box in a somewhat conventional manner. In this regard, a paper currency banknote 50 is introduced into the entrance port 78 of the bill acceptor 26. The bill acceptor includes a pair of motor-driven drive belts 80 (FIG. 3), each of which engages a respective peripheral edge of the banknote 50 to carry the banknote down a path in the validator past plural internal sensors (not shown) to an "escrow" position in the apparatus 20 where the banknote is held temporarily. The sensors of the validator in conjunction with a microprocessor (not shown) forming a portion of the electronics 32 of the apparatus 20 determine whether or not the banknote is genuine, and its denomination. If the banknote is not genuine, the belts 80 are driven in the reverse direction so that the banknote is ejected from the bill validator mouth 78. If, however, the banknote is determined to be valid, it is "accepted" and carried by an associated pair of narrow drive belts 82 (to be described later) of the transporting mechanism 28 down a path 84 until it is oriented vertically so that its leading edge, i.e., the narrow end of the banknote, enters through the slot 76 in the top wall of the cash box.

As is conventional, the bill acceptor or validator 26 includes a motor (not shown) for driving an associated gear 86 which in turn drives the validator transporting belts 80. The gear 86 also engages an associated gear 88 in the transporting mechanism 28. The gear 88 drives a roller 90 about which the transporting mechanism's drive belts 82 extend. The drive belts 82 are each narrow in width and extend in respective grooves in the ends of the roller 90 and about respective grooves in the ends of another roller 92. A gear 94 is mounted on the roller 92. The roller 94 is disposed below the roller 90 and immediately above the slot 76 in the top wall of the cash box 22. An idler roller 96 confronts the roller 92. Another idler roller 98 engages both belts 82 in between the rollers 90 and 92. The drive belts 82 and the rollers 90, 92, 96 and 98 establish a banknote carrying path between the bill validator 26 and the cash box 22. The banknote carrying path first extends at an acute angle downward from the bill validator 26, and then extends vertically downward at 84 to the note entrance slot 76 in the cash box 22. Thus, the banknote from the bill validator 26 is carried between the belts 82 and the idler rollers 96 and 98 so that its leading edge enters the slot 76 in the top of the cash box. Each of the belts 82 of the transporting mechanism 28 is formed of a resilient material for frictionally engaging a respective peripheral longitudinal edge of the banknote to be transported thereby to carry the banknote into the cash box. A drive gear 100 which meshes with gear 94 is mounted on the frame 38 to engage a gear (to be described later) forming a portion of the banknote conveyor subassembly 44 within the cash box 22.

Figure 5:
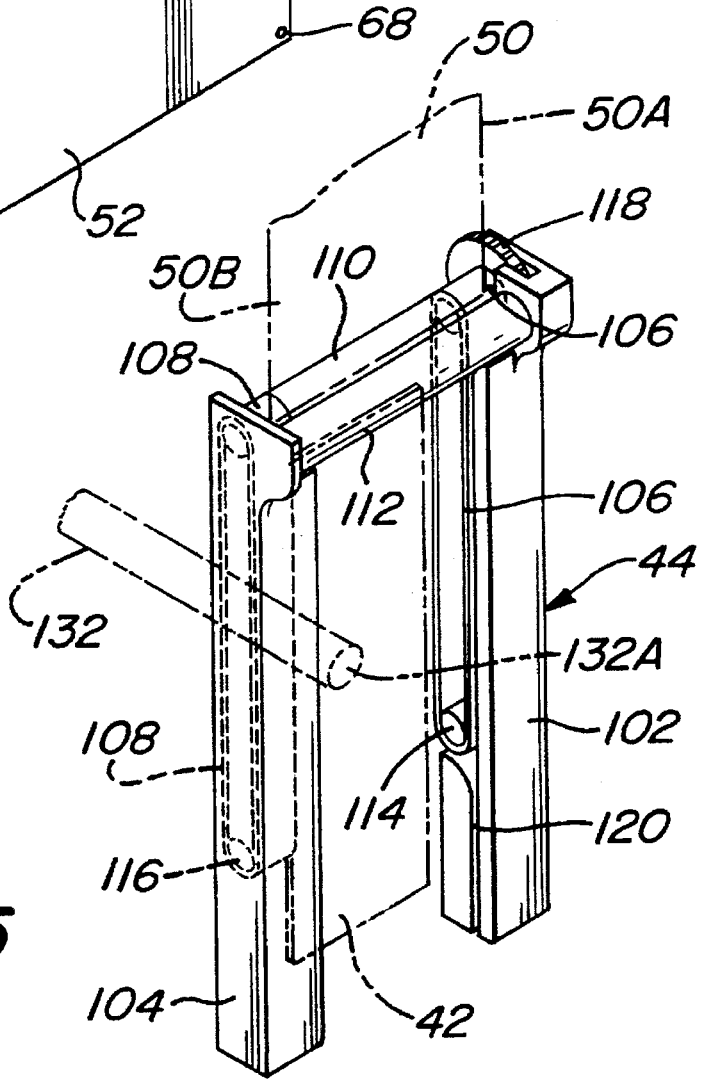
FIG. 5 is an enlarged isometric view of a portion of the stacker box of FIG. 1.
Figure 3:
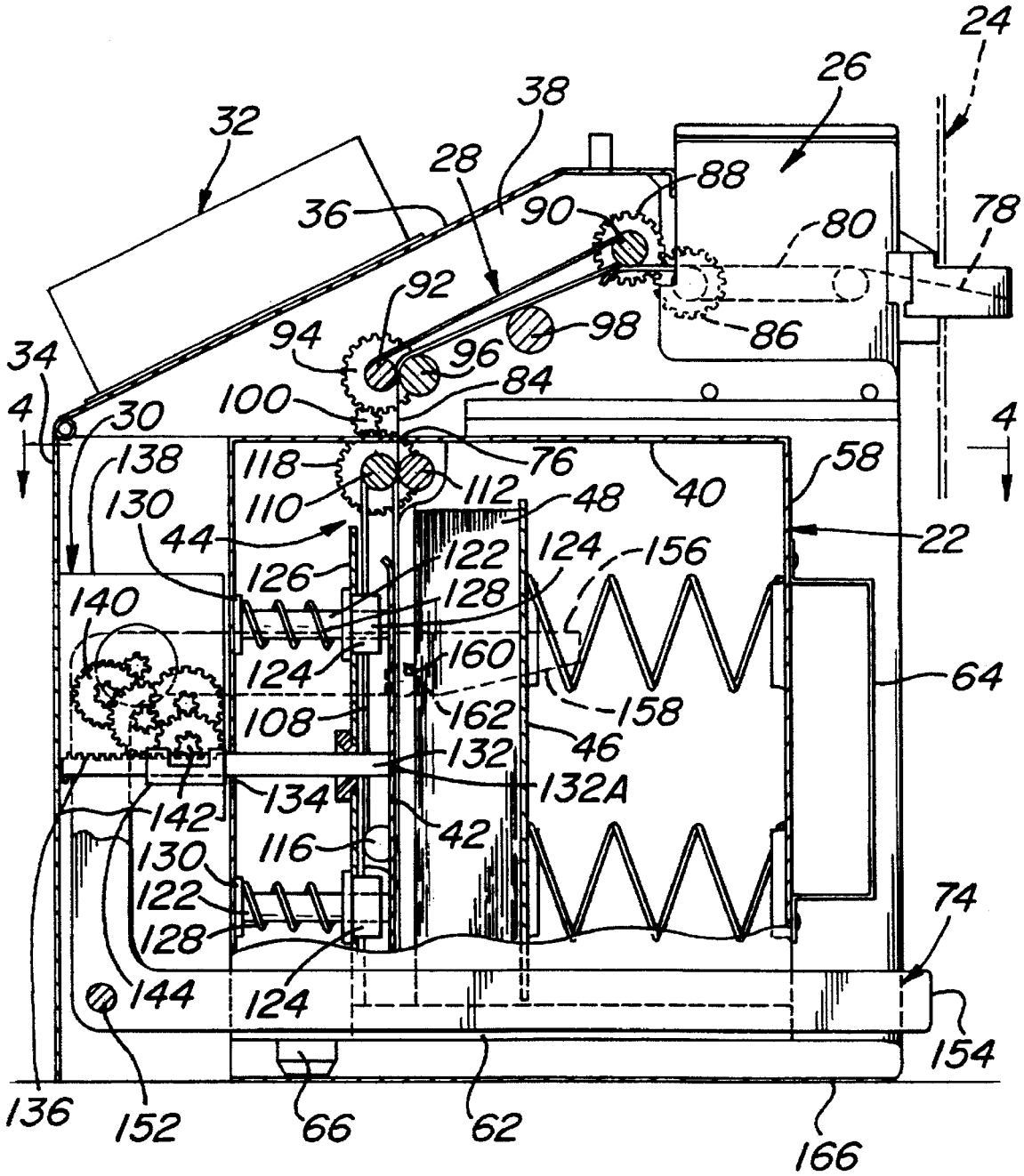
FIG. 3 is a reduced sectional view taken along line 3—3 of FIG. 2.

The banknote conveyor subassembly 44 of the cash box will now be described. In particular, as can be seen in FIGS. 3 through 5, the cash box conveyor subassembly 44 basically comprises a pair of banknote guide members 102 and 104, an associated pair of drive belts 106 and 108, associated rollers 110, 112, 114 and 116, and a drive gear 118. The guide members 102 and 104 each include a vertical channel 120 (to be described later) into which a portion of the drive belts 106 and 108, respectively, extend for a portion of the length thereof. The channels 120 are disposed opposite each other to form therebetween a vertical path through which the banknote is conveyed by the belts 106 and 108. The belts are mounted to extend about respective ones of the rollers. In particular, the roller 110 is an elongated member which is mounted for rotation about a horizontal axis within the cash box immediately below the banknote access slot 76 and at the top of the channels 120. The gear 118 is fixedly mounted on the roller 110 at one end thereof.

The drive belt 106 extends about the end portion of the elongate roller 110 adjacent the gear 118. That belt extends partially down the channel 120 to an intermediate point where it extends about the roller 114. The roller 114 is also mounted for rotation about a horizontal axis. The belt 108 extends about the opposite end of the elongate roller 110 and partially down the channel 120 to an intermediate point where it extends about the roller 116 located therein. The roller 116 is mounted for rotation about the same horizontal axis as the roller 114. The roller 112 is also an elongated member which is mounted for rotation about a horizontal axis and is disposed immediately adjacent and confronting the elongated roller 110 at the top of the channels 120 form a passageway therebetween into which the banknote 50 enters.

The drive gear 118 is mounted so that a portion of its periphery extends out a small slot 118A (FIG. 1) in the top wall 60 of the cash box shell 40. This extending gear portion is arranged to be engaged by the gear 100 forming a portion of the transporting mechanism 28 of the apparatus 20. In particular, the gear 100 engages the gear 118 on the roller 110 of the transport mechanism 44, so that rotation of the drive belts 82 of that mechanism effects the rotation of the gear 94, which in turn effects the rotation of the drive gear 100. The latter causes the drive gear 118 to rotate. Rotation of the drive gear 118 causes the elongated roller 110 to rotate, whereupon the drive belts 106 and 108 of the conveyor subassembly rotate. Like the belts 82 of the transporting mechanism 28, the belts 106 and 108 of the cash box's conveyor subassembly 44 are formed of a resilient material for frictionally engaging a respective peripheral longitudinal edges 50A and 50B of the banknote 50. In particular, the belts 106 and 108 frictionally engage the longitudinal peripheral edges of the banknote introduced between the confronting elongated rollers 110 and 112, whereupon the banknote is carried down the channels 120 into the interior of the cash box until it is located in a vertical plane immediately in front of the punch plate 42.

As can be seen clearly in FIG. 5 the guide members 102 and 104 are spaced apart by a distance which is slightly less than the width of a banknote 50, while their channels 120, are spaced apart by a distance equal to at least as wide as the width of the banknote. The channels 120 serve as the support and guide for the longitudinal edges of the banknote 50. In this regard, when a banknote 50 is introduced into the cash box 22 its peripheral longitudinal edges 50A and 50B are engaged by the drive belts 106 and 108, respectively, to pull those edges into the channels. The belts draw the banknote 50 down the opposed channels, with the banknote being precluded from popping out by the portions of the guide members contiguous with the channels engaging the peripheral longitudinal edges of the banknote. The banknote is carried down the channels by the belts 106 and 108 to the vertical position immediately in front of the punch plate 42.

The punch plate 42 basically comprises a rectangular metal plate mounted on a pair horizontally extending mounting rods 122. The mounting rods 122 are supported by respective Teflon® material guide bushings or sleeves 124 on a plate 126 projecting inward from the interior surface of the side wall 52 of the cash box so that the rods 122 can slide or reciprocate horizontally within the bushings. A pair of helical biasing springs 128 are disposed about the mounting rods 122. Each of the springs is interposed between its associated bushing sleeve 124 and an associated retainer clip 130 on the associated rod 122. The springs 128 bias the punch plate to a "neutral" position shown in FIGS. 4 and 5, whereupon the punch plate is located immediately adjacent or confronting the belts 106 and 108 of the cash box's conveyor subassembly 44.

It is from this "neutral" position that the punch plate 42 is pushed by the rod mentioned earlier (and which will be described hereinafter), to carry the banknote 50 from the conveyor subassembly 44 onto the receiver's banknote holding plate 46. The rod forms a portion of the motor drive assembly 30 of the apparatus 20. In particular, the rod comprises an elongated shaft 132 having a free end 132A which is arranged to extend through a small circular aperture 134 the cash box's shell to engage the pusher plate 42 to reciprocate it. The shaft 132 includes a flatted surface along one end. The flatted surface includes plural teeth to form a rack 136.

The motor drive assembly 30 basically comprises an electric motor 138 and associated gear train 140. The gear train includes plural gears, one of which is coupled to the rotary output shaft (not shown) of the motor. The last of the gears of the gear train 142 is designated by the reference number 142 and serves as a pinion to engage the rack 136 of the shaft 132. The shaft is mounted in a Teflon® material guide member 144. The guide member 144 is itself mounted on a bracket 146 in the housing 34 of the apparatus 20 so that the shaft 132 is oriented horizontally.

As mentioned earlier the free end 132A of the pusher rod 132 is arranged to be extended through the small aperture 134 located in the rear wall 56 of the cash box's shell 40 when the cash box is mounted in the apparatus 20. When this has been accomplished the free end of the shaft 132A abuts the central portion of the pusher plate 42 in the heretofore identified "neutral" position.

When the motor 138 is operated the pinion gear 142 engages the rack 136 to translate the rotary motion of the motor's output shaft into reciprocating motion of the push rod 132. Accordingly, the rod 132 is pushed inward further into the interior of the cash box to carry or push the pusher plate 42 from its neutral position towards the receiver's banknote holding plate 46. In particular, the inward movement of the punch plate 42 causes it to engage the banknote 50 held within the channels 120 of the guide members 102 and 104 to push the banknote 50 out of engagement therewith. The width of the punch plate 42 is less than the spacing between the guide members 102 and 104 forming the channels 120 so that when the punch plate 42 engages the banknote 50 it clears those members to push the banknote 50 onto the stack of banknotes 48 on the holding plate 46. In particular, as the punch plate pushes the banknote out of the channels, the marginal edges 50A and 50B of the banknote bend slightly. Once the banknote is free of the guide members 102 and 104, e.g., on the stack 48, it automatically flattens out and forms the top bill or banknote of the stack.

The banknote holding plate 46 is best seen in FIGS. 3 and 4. As can be seen therein that plate is a generally rectangularly shaped planar member which is biased toward the pusher plate 42. The means for biasing the plate 46 constitute a pair of biasing springs 148 interposed between the holding plate 46 and the inside surface of the front wall 58 of the cash box 22. The width of the holding plate is wider than the width of the banknotes (and the spacing between the guide members 102 and 104) so that the biasing springs 148 cannot push the holding plate 46 past the guide members 102 and 104. This ensures that once a banknote 50 is on the stack 48 it cannot get pushed back into the channels 120 of the guide members.

The details of the latching means 74 for releasably securing the cash box 22 to the apparatus 20 will now be described with reference to FIGS. 3 through 5. Thus, as can be seen therein the latching means 74 comprises a pair of generally U-shaped, planar, latch bars 150 connected together by a common pivot shaft 152. Each bar 150 is mounted within the apparatus' housing 34 so that it lies alongside a respective side wall of the cash box 22 when the cash box is in place in the apparatus 20. The bottom portion of each bar 150 is in the form of a handle 154 projecting outward beyond the front of the cash box to enable either of the handles 154 to be grasped. The pivot shaft 152 is journaled to the walls of the apparatus' housing 34 and is fixedly secured to the bars 150 so that when either handle 154 is lifted upward the two bars 150 pivot as a unit about the axis of the shaft 152. The upper end 152 of each bar is in the form of a catch portion 156 having a cam surface 158 leading to a groove 160. Each groove 160 is arranged to receive a respective stud 162 of the cash box (which studs are located on sidewalls 52 and 54) to lock the cash box to the apparatus 22. To that end when the cash box is pushed into the apparatus' housing 34 the cam surfaces 158 of the latch bars 150 ride on the studs 162 projecting outward from the side walls 52 and 54 of the cash box. This causes the latch bars to pivot upward, i.e., rotate in the counter clockwise direction in FIG. 3., so that the studs 162 enter the grooves 160. At this time the latch bars pivot back down slightly (i.e., clockwise), thereby locking the studs 162 in the grooves. In order to keep the cash box 22 centered in the housing 20 a pair of spacers 164 project inward from the inside surfaces of the apparatus' housing 34, as shown in FIG. 2. A spacer plate 166 projects upward from the bottom of the apparatus housing 34 to support the cash box thereon.

As should be appreciated from the foregoing since the pusher rod 132, and the drive motor assembly 30 including the gear train 140 form a portion of the apparatus 20, and not of the cash box 22, the cash box is able to be very simple in construction. In this regard, it basically comprises a simple bill conveyor mechanism 44, a simple punch plate 42 (and associated mounting components), and a simple bill receiving holding plate 46 (and associated mounting components). Thus, a number of cash boxes 22 constructed in accordance with this invention can be manufactured and maintained inexpensively for use with the apparatus 20. Moreover, the apparatus 20 is also of somewhat simple construction since it makes use of a simple mechanism, i.e., a reciprocating pusher rod 132, to engage the punch plate 46 within the cash box. Since the access of the pusher rod into the cash box is effected through a very small opening or aperture 134, security for the banknotes 50 within the cash box is maintained. In this regard one cannot gain access to the banknotes through the small access opening 134, nor through the narrow slot 76 into which the banknotes are introduced into the cash box. The only means of access to the interior of the cash box is through its lockable door 62.

Without further elaboration the foregoing will so fully illustrate our invention that others may, by applying current or future knowledge, adapt the same for use under various conditions of service.

We claim:

1. Apparatus for validating paper currency banknotes and for forming a stack of said validated banknotes, said apparatus comprising a removable stacker box, note acceptor means for validating a paper currency banknote inserted therein, transport means for carrying the validated banknote to said stacker box, and drive means, said transport means comprising a first motor, said drive means including a second motor, a pusher member, and rotary-to-linear motion translation means, said pusher member being coupled to said second motor by said rotary-to-linear motion translation means, said pusher member being arranged to be reciprocated linearly, said currency stacker box comprising an enclosed shell, a receiver, carrier means, and a pusher plate, said shell having a hollow interior, a first small access aperture, a lockable door, and a narrow slot, said narrow slot being sized for enabling the validated banknote to pass edgewise therethrough into said interior, said receiver being disposed within said interior for receipt of the validated banknote to form a stack of such banknotes, said carrier means being located within said interior for carrying the validated note from said slot to a predetermined position within said interior adjacent said pusher plate, said pusher plate being arranged for pushing the validated note from said predetermined position to said receiver to form the stack of banknotes, said pusher member having an elongated linear portion terminating in a free end of small cross sectional area arranged to extend through said first small access aperture in said stacker box shell to a position immediately adjacent said pusher plate when said stacker box is releasably secured to said apparatus, whereupon the operation of said second motor causes said pusher member to be moved linearly towards said pusher plate to move said pusher plate towards said holding plate to thereby push the validated banknote to said receiver, said pusher member and said pusher plate being arranged to be moved linearly away from said holding plate after the validated banknote is pushed to said receiver.

2. The apparatus of claim 1 wherein said carrier means comprises a drive belt means for engaging a peripheral edge portion of the banknote.

3. The apparatus of claim 2 wherein said carrier means additionally comprises two pair of guiding members, said members of each pair being disposed opposite each other to form a respective channel for receipt of a respective peripheral side edge of the validated banknote therein, said drive belt means comprising a pair of belts, with one of said belts disposed adjacent one of said channels and with the other of said belts disposed adjacent the other of said channels, said belts being arranged for carrying the validated banknote along said channels to said predetermined position.

4. The apparatus of claim 3 wherein said pairs of guiding members prevent the banknotes in the stack from returning into said channels.

5. The apparatus of claim 2 wherein said carrier means comprises gear means disposed within said interior and arranged to be coupled to said validated note transport means, said gear means operating said drive belt means to move the validated banknote to said predetermined position.

6. The apparatus of claim 3 wherein said carrier means additionally comprises two pair of guiding members, said members of each pair being disposed opposite each other to form a respective channel for receipt of a respective peripheral side edge of the validated banknote therein, said drive belt means comprising a pair of belts, with one of said belts disposed adjacent one of said channels and with the other of said belts disposed adjacent the other of said channels, said belts being arranged for carrying the validated banknote along said channels to said predetermined position.

7. The apparatus of claim 6 wherein said pairs of guiding members prevent the banknotes in the stack from returning into said channels.

8. The apparatus of claim 1 wherein said said receiver comprises a holding plate which is biased by first biasing means toward said pusher plate.

9. The apparatus of claim 1 additionally comprising at least one guide rod to guide the reciprocating movement of said pusher plate.

10. The apparatus of claim 9 wherein said said receiver comprises a holding plate which is biased by first biasing means toward said pusher plate, and wherein said apparatus additionally comprises spring means coupled to said at least one guide rod for biasing said pusher plate away from said holding plate.

11. The apparatus of claim 1 wherein said drive means additionally comprises a gear located outside said currency stacker box and forming a portion of said rotary-to-linear motion translation means, and wherein said pusher member comprises a pusher rod, said pusher rod including a surface portion forming a portion of said rotary-to-linear motion translation means and being arranged for cooperating engagement with said gear to cause the linear reciprocation of said pusher rod and said pusher plate coupled thereto.

12. The apparatus of claim 1 wherein said shell additionally comprises a lockable door to provide access to said interior of said shell.

13. The apparatus of claim 1 additionally comprising means for releasably securing said currency stacker box to said apparatus.

14. The apparatus of claim 13 wherein said last mentioned means comprises at least one projection from said box and a movable latching member of said apparatus, said movable latching member being arranged to selectively engage and trap said projection of said box.

* * * * *